US007094998B2

(12) United States Patent
Shozo et al.

(10) Patent No.: US 7,094,998 B2
(45) Date of Patent: Aug. 22, 2006

(54) HEATING COOKER

(75) Inventors: Kobayashi Shozo, Suwon (KR); Jang Jun Lee, Suwon (KR); Yun Ic Hwang, Suwon (KR); Pung Yeun Cho, Suwon (KR); Dong Wok Ko, Suwon (KR); Hyung Min Kim, Seoul (KR); Kwang Keun Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/749,378

(22) Filed: Jan. 2, 2004

(65) Prior Publication Data

US 2004/0200831 A1 Oct. 14, 2004

(30) Foreign Application Priority Data

Apr. 10, 2003 (KR) ..... 10-2003-0022700

(51) Int. Cl.
*H05B 6/80* (2006.01)
*A21B 1/26* (2006.01)
*H05B 6/68* (2006.01)

(52) U.S. Cl. ..... 219/681; 219/685; 219/400; 219/757; 126/21 A; 99/451

(58) Field of Classification Search ..... 219/680–685, 219/756–757, 751, 400; 126/21 A, 21 R; 99/473–476, 451
See application file for complete search history.

(56) References Cited

U.S. PATENT DOCUMENTS 3,692,968 A * 9/1972 Yasuoka ..... 219/681
4,337,384 A * 6/1982 Tanaka et al. ..... 219/681
4,970,372 A * 11/1990 Fleiter et al. ..... 219/400
5,601,070 A * 2/1997 Hotard et al. ..... 126/21 A
6,376,817 B1 * 4/2002 McFadden et al. ..... 219/681
6,615,819 B1 * 9/2003 Hernandez Burgos et al. ... 126/21 A

FOREIGN PATENT DOCUMENTS

| | | | |
|---|---|---|---|
| GB | 2 112 610 | * | 7/1983 |
| JP | 56-102623 | * | 8/1981 |
| JP | 8-247473 | | 3/1995 |

* cited by examiner

*Primary Examiner*—Philip H. Leung
(74) *Attorney, Agent, or Firm*—Staas & Halsey LLP

(57) ABSTRACT

A heating cooker which evenly heats or cooks food, and is easily cleaned, includes a cabinet to define a cooking cavity therein. The cooking cavity is open at a front thereof. A fan chamber is defined by recessing a rear wall of the cooking cavity at a predetermined area to a predetermined depth. An air circulation fan and a heater are installed in the fan chamber. The air circulation fan circulates air of the cooking cavity. The heater heats the air in the fan chamber. A chamber cover is mounted to the rear wall of the cooking cavity to cover an open front of the fan chamber. The chamber cover has a plurality of air suction ports at a central area thereof, with a plurality of air distribution ports provided along an edge of the chamber cover to guide the air from the fan chamber to the edge of the chamber cover so as to discharge the air to the cooking cavity.

7 Claims, 10 Drawing Sheets

HEATING COOKER

CROSS REFERENCE TO RELATED APPLICATIONS

This application claims the benefit of Korean Application No. 2003-22700, filed Apr. 10, 2003, in the Korean Intellectual Property Office, the disclosure of which is incorporated herein by reference.

BACKGROUND OF THE INVENTION

1. Field of the Invention

The present invention relates, in general, to heating cookers and, more particularly, to a heating cooker which evenly heats or cooks food, and is easily cleaned.

2. Description of the Related Art

Japanese Patent Laid-open Publication No. Heisei 8-247473 discloses a conventional heating cooker. In the Japanese heating cooker, a cabinet is fabricated with two casings, that is, an outer casing and an inner casing. The outer casing defines an appearance of the cabinet, while the inner casing, defining a cooking cavity therein, is placed in the outer casing. The cooking cavity is opened at a front thereof, and the opened front of the cooking cavity is closed by a door which is attached by hinges to a lower edge of the cabinet so as to rotate upward to close the cooking cavity and rotate downward to open the cooking cavity. A fan chamber is provided at a rear wall of the cooking cavity by recessing a circular area of the rear wall to a predetermined depth. An air circulation fan and a heater are installed in the fan chamber. The air circulation fan circulates air of the cooking cavity, while the heater heats the air in the fan chamber before the air is distributed to the cooking cavity. A chamber cover is installed at an inlet of the fan chamber so as to cover the circulation fan and heater installed in the fan chamber.

The chamber cover is a circular disc-shaped member with a diameter less than a diameter of the inlet of the fan chamber. Therefore, when the chamber cover is mounted to the inlet of the fan chamber (for example, through a welding process), so as to cover the fan chamber, an annular gap is defined between an outer edge of the chamber cover and an edge of the inlet of the fan chamber. The annular gap acts as an air distribution gap through which the air is distributed from the fan chamber to the cooking cavity. A plurality of air suction ports are provided at a central area of the chamber cover, so that the air is sucked from the cooking cavity into the fan chamber through the air suction ports due to suction force generated by the air circulation fan rotated in the fan chamber. In the fan chamber, the air is forced outward in radial directions of the air circulation fan, and is heated by the heater installed outside a circumference of the air circulation fan, thus becoming hot air. The hot air is, thereafter, distributed from the fan chamber into the cooking cavity through the air distribution gap between the outer edge of the chamber cover and the edge of the inlet of the fan chamber. Food on a rack inside the cooking cavity is thus heated and cooked by the hot air distributed from the fan chamber into the cooking cavity through the air distribution gap.

However, the conventional heating cooker is problematic as follows. That is, the conventional heating cooker is designed such that the hot air, distributed from the fan chamber into the cooking cavity through the air distribution gap provided at the rear wall of the cooking cavity, is forced forward to the food on the rack inside the cooking cavity. The hot air is thus undesirably concentrated to a part of the food, so that the part of the food to which the hot air is concentrated may be excessively cooked or burnt whereas another part of the food may not be desirably cooked. That is, the conventional heating cooker may fail to cook food evenly, and, sometimes, burn a part of the food.

In addition, the air distribution gap of the conventional heating cooker allows foods to enter the fan chamber and contaminate the air circulation fan, heater, and walls of the fan chamber when the food sputters in the cooking cavity during a cooking process. Furthermore, the chamber cover is welded to the inner casing, so that it is impossible for a user to remove the chamber cover from the inner casing or to clean the contaminated interior of the fan chamber.

During a microwave-cooking mode of the conventional heating cooker in which food is cooked by use of microwaves generated by a magnetron, an electromagnetic field is formed at welded junctions between the chamber cover and the rear wall of the cooking cavity. In such a case, sparks occur undesirably at the welded junctions.

Another disadvantage experienced in the conventional heating cooker resides in that the microwaves are introduced from the cooking cavity into the fan chamber through both the air suction ports of the chamber cover and the air distribution gap provided around the chamber cover. Thus, it is necessary to provide a caulked structure at a junction between a motor shaft of the air circulation fan and a shaft bearing provided at a rear part of the fan chamber to prevent leaking of the microwaves from the fan chamber to the atmosphere through the junction. The caulked structure undesirably complicates a rear structure of the cooking cavity, and increases production cost of the heating cooker.

SUMMARY OF THE INVENTION

Accordingly, it is an aspect of the present invention to provide a heating cooker which evenly distributes hot air from a fan chamber to a space around food in a cooking cavity, instead of directly distributing the hot air to the food, thus evenly heating and cooking the food without excessively cooking or burning a part of the food.

It is another aspect of the present invention to provide a heating cooker, which prevents foods from entering the fan chamber even when the food sputters in the cooking cavity during a cooking process, and allows a user to easily remove a chamber cover from the fan chamber when it is required to clean the fan chamber.

It is a further aspect of the present invention to provide a heating cooker in which sparks do not occur at a chamber cover or an inner casing even in the case of a microwave-cooking mode, and which prevents the microwaves from being introduced into the fan chamber. Thus, the fan chamber does not require a structure to prevent leaking of the microwaves to the atmosphere at a rear part thereof, and has a simple structure at the rear part of the fan chamber and reduces the production cost thereof.

Additional aspects and advantages of the invention will be set forth in part in the description which follows and, in part, will be obvious from the description, or may be learned by practice of the invention.

The foregoing and/or other aspects of the present invention are achieved by providing a heating cooker, including a cabinet to define a cooking cavity therein and opened at a front thereof, a fan chamber defined by recessing a rear wall of the cooking cavity at a predetermined area to a predetermined depth, an air circulation fan installed in the fan chamber to circulate air of the cooking cavity, a heater installed in the fan chamber to heat the air, and a chamber cover mounted to the rear wall of the cooking cavity to cover an open front of the fan chamber. The chamber cover has a plurality of air suction ports at a central area thereof, with a plurality of air distribution ports provided along an edge of the chamber cover to guide the air from the fan chamber to the edge of the chamber cover so as to discharge the air to the cooking cavity.

According to an aspect of the invention, a microwave-supplying unit is installed in the cabinet to supply microwaves into the cooking cavity, and both an inner surface of the inner casing and the chamber cover are coated with an insulating material so as to prevent occurrence of sparks caused by the microwaves at both the inner casing and the chamber cover.

According to an aspect of the invention, the air distribution ports are defined by a plurality of protuberant parts which are provided along the edge of the chamber cover by protruding predetermined portions of the edge of the chamber cover toward the cooking cavity, so that the protuberant parts form channels directed outward and open at the edge of the chamber cover.

According to an aspect of the invention, the chamber cover is a size larger than a size of the open front of the fan chamber to cover the open front of the fan chamber, and is mounted to an inner surface of the rear wall of the cooking cavity, so that a gap is maintained between the edge of the chamber cover and the inner surface of the rear wall of the cooking cavity to prevent the microwaves from being introduced from the cooking cavity into the fan chamber and prevent occurrence of sparks caused by the microwaves at a portion where the chamber cover is mounted to the inner casing.

According to an aspect of the invention, the chamber cover is mounted to the inner surface of the rear wall of the cooking cavity by use of a plurality of setscrews, and at least one boss is provided on either the chamber cover or the inner surface of the rear wall of the cooking cavity at a portion where the chamber cover is screwed to the rear wall of the cooking cavity by use of the setscrews, thus maintaining the gap between the edge of the chamber cover and the inner surface of the rear wall of the cooking cavity.

According to an aspect of the invention, a sensing switch is provided outside the cooking cavity to sense a tightened or released state of the setscrews which mount the chamber cover to the rear wall of the cooking cavity.

According to an aspect of the invention, the gap maintained between the edge of the chamber cover and the inner surface of the rear wall of the cooking cavity is set to 3 mm.

According to an aspect of the invention, the edge of the chamber cover is folded to provide a thick edge which prevents an electromagnetic field from being provided at the edge of the chamber cover.

According to an aspect of the invention, each of the air distribution ports has a circumference of $\lambda/2$ or less.

According to an aspect of the invention, a food rack is provided in the cooking cavity so as to support food therein, and the chamber cover is mounted to an inner surface of the rear wall of the cooking cavity by use of a setscrew, the setscrew being installed at a position to correspond to the food rack.

According to an aspect of the invention, the heating cooker further includes a wave-stirrer unit to stir the microwaves supplied from the microwave-supplying unit to the cooking cavity. The wave-stirrer unit includes a stirrer fan rotatably installed at a path through which the microwaves is supplied from the microwave-supplying unit to the cooking cavity, and a drive motor to rotate the stirrer fan.

According to an aspect of the invention, a food rack having an embedded heater is provided in the cooking cavity so as to support food therein, and a power connector is provided on the rear wall of the cooking cavity at a position to correspond to the food rack so as to supply electric power to the embedded heater of the food rack.

According to an aspect of the invention, the fan chamber is placed at a left or right side of the rear wall of the cooking cavity, and the power connector is provided on the rear wall of the cooking cavity at a side which does not have the fan chamber.

According to an aspect of the invention, when the power connector is placed at the left side of the rear wall of the cooking cavity, the air circulation fan is rotated counter-clockwise, and when the power connector is placed at the right side of the rear wall of the cooking cavity, the air circulation fan is rotated clockwise.

According to an aspect of the invention, the fan chamber is defined in the rear wall of the cooking cavity to have a rectangular shape, and is tilted to a side so that a lower surface of the fan chamber is inclined.

According to an aspect of the invention, the chamber cover has a rectangular shape so as to cover the open front of the fan chamber, and a number of the air circulation ports, provided at upper and lower sides of the edge of the chamber cover at trailing positions relative to a rotating direction of the air circulation fan, is larger than a number of the air circulation ports provided at leading positions relative to the rotating direction of the circulation fan.

According to an aspect of the invention, at least one heat-shielding unit is mounted to an outer surface of the cooking cavity at a position outside the fan chamber, and a drive motor to rotate the air circulation fan is installed outside the heat-shielding unit.

According to an aspect of the invention, the heat-shielding unit includes a first heat-shielding plate mounted at a position outside the fan chamber, and a second heat-shielding plate mounted at a position outside the first heat-shielding plate while being spaced apart from the first heat-shielding plate, and the drive motor to rotate the air circulation fan is mounted to an outside surface of the second heat-shielding plate by a motor bracket.

According to an aspect of the invention, a cooling fan is installed at a lower portion inside the cabinet so as to cool the drive motor that rotates the air circulation fan.

According to an aspect of the invention, the microwave-supplying unit is installed in the cabinet at a position above the cooking cavity, and a cooling fan is installed in the cabinet at a position around the microwave-supplying unit so as to cool the microwave-supplying unit.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
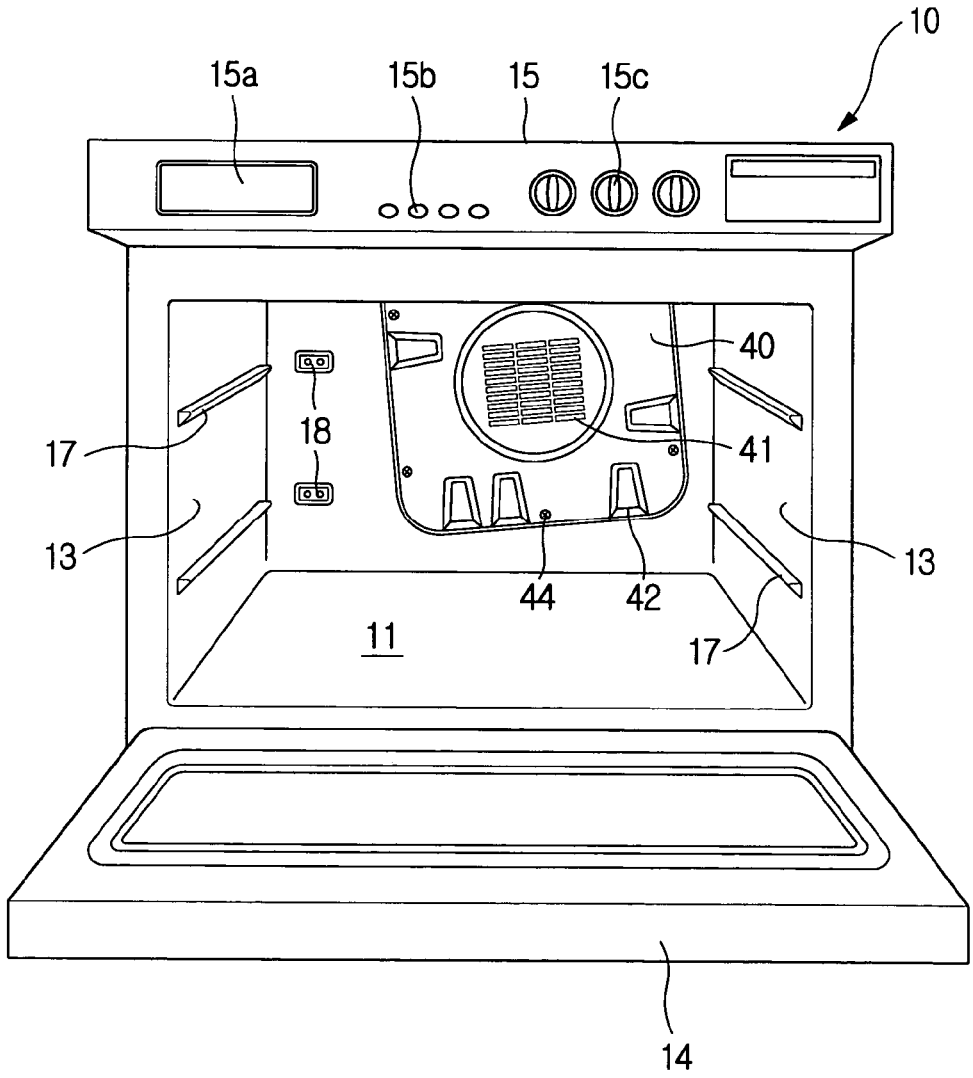
FIG. 1 is a front perspective view of a heating cooker, according to an embodiment of the present invention.

Reference will now be made in detail to the present preferred embodiments of the present invention, examples of which are illustrated in the accompanying drawings, wherein like reference numerals refer to like elements throughout.

Figure 2:
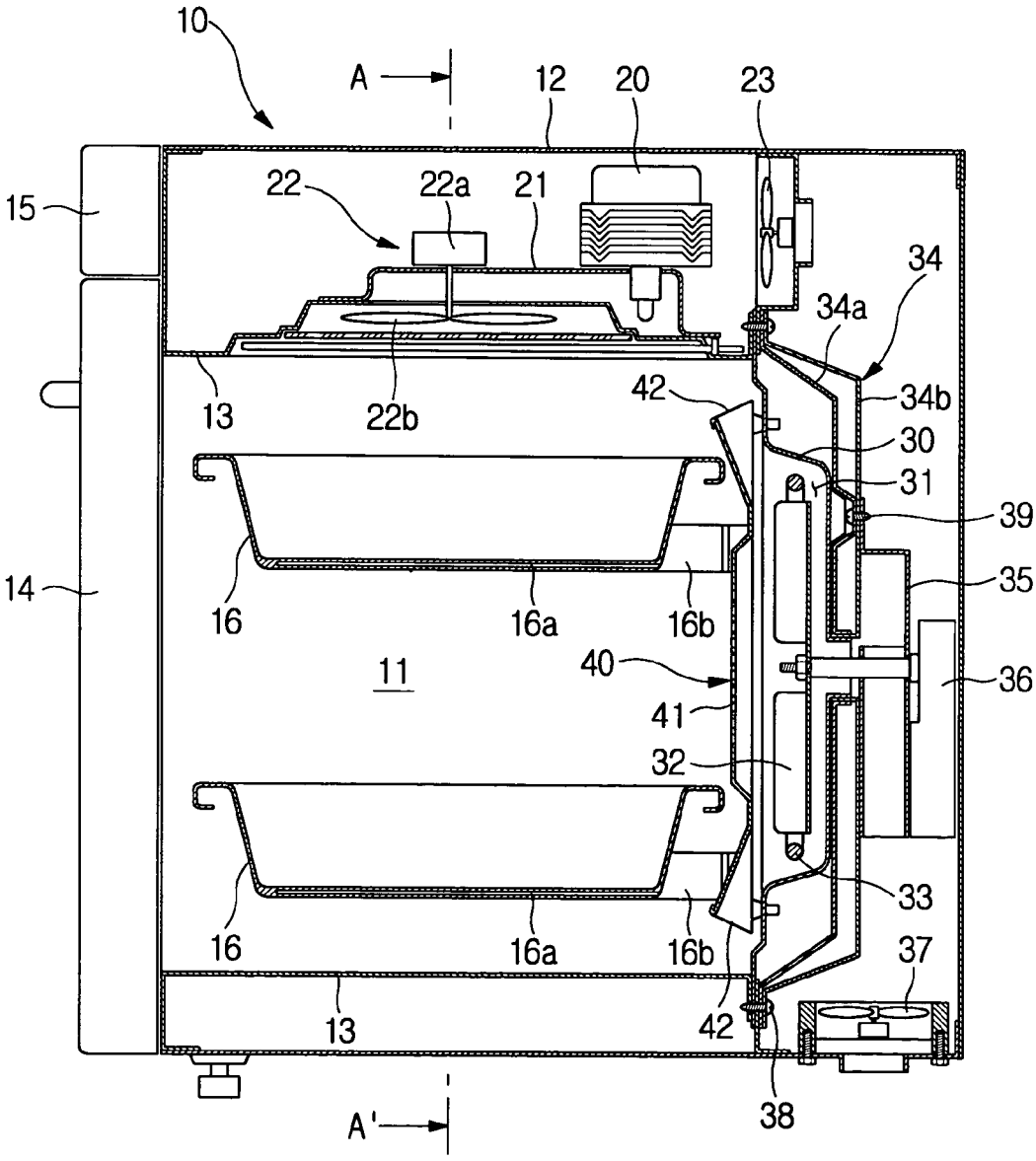
FIG. 2 is a sectional view of the heating cooker of FIG. 1.

FIGS. 1 and 2 are views of a heating cooker, according to an embodiment of the present invention. As shown in the drawings, the heating cooker according to the present invention includes a cabinet 10 having two casings, that is, an outer casing 12 and an inner casing 13. The outer casing 12 is made of a steel sheet, and defines an appearance of the cabinet 10, while the inner casing 13, defining a cooking cavity 11 therein, is placed in the outer casing 12 with a gap maintained between the outer and inner casings 12 and 13. The cooking cavity 11, defined in the inner casing 13, is open at a front thereof so as to allow a user to put food into or take food out of the cooking cavity 11. The opened front of the cooking cavity 11 is closed by a door 14 which is attached by hinges to a lower edge of the cabinet 10 so as to rotate upward to close the cooking cavity 11 and rotate downward to open the cooking cavity 11. A control panel 15 is provided on the front of the cabinet 10 at an upper portion above the door 14. The control panel 15 includes a display window 15*a* to display operational states of the heating cooker thereon, a variety of control buttons 15*b*, and a variety of control switches 15*c*.

A plurality of food racks 16 are provided at upper and lower sections in the cooking cavity 11 so as to support food therein during a cooking process. The food racks 16 are drawer-type racks, each of which is movably held on two guide rails 17 provided at inner surfaces of opposite sidewalls of the inner casing 12. The food racks 16 are drawn out of or into the cooking cavity 11.

A machine room is provided in a space between the outer and inner casings 12 and 13 at a position above the cooking cavity 11, and houses a microwave-supplying unit therein. The microwave-supplying unit includes a magnetron 20, a wave-guide 21, and a wave-stirrer unit 22 therein. The magnetron 20 generates microwaves, while the wave-guide 21 guides the microwaves from the magnetron 20 into the cooking cavity 11. The wave-stirrer unit 22 stirs the microwaves guided from the magnetron 20 to the cooking cavity 11 through the wave-guide 21 so as to evenly distribute the microwaves into the cooking cavity 11. A first cooling fan 23 is installed in the machine room at a position at the back of the magnetron 20 to cool both the magnetron 20 and the wave-stirrer unit 22. The wave-stirrer unit 22 includes a stirrer fan 22*b* which is rotatably installed at an outlet of the wave-guide 21. The stirrer fan 22*b* is rotated by a first drive motor 22*a* which is mounted to an outer surface of an upper wall of the wave-guide 21. Due to the above-described elements provided in the machine room, it is possible to cook food in the cooking cavity 11 through a microwave-cooking mode.

Figure 7:
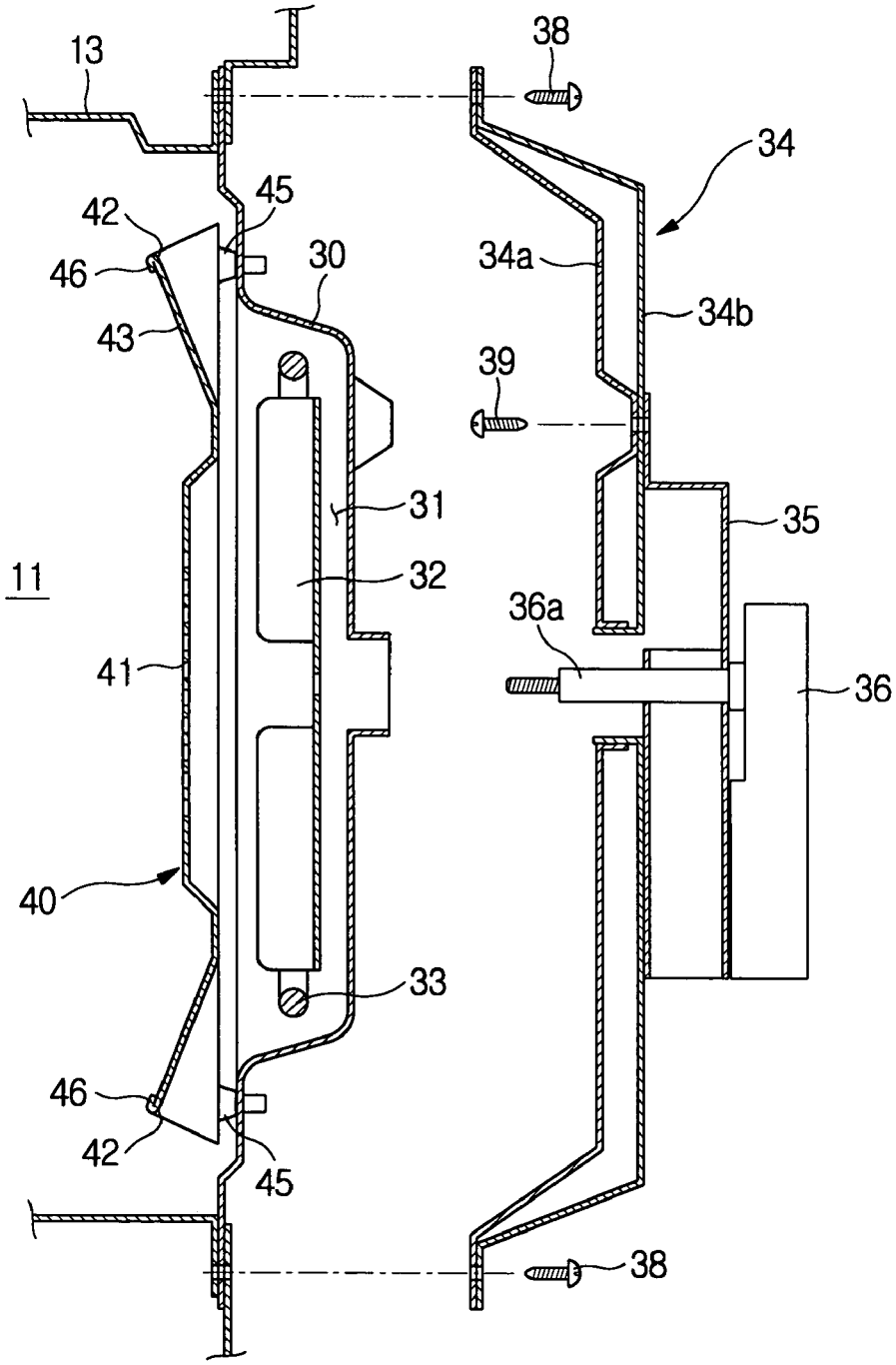
FIG. 7 is a sectional view of the fan chamber included in the heating cooker of FIG. 1, when the fan chamber is exploded into parts.

As shown in FIGS. 2 and 7, a rear wall of the cooking cavity 11 is recessed in a predetermined area thereof to a predetermined depth, providing a recessed rear wall 30 to define a fan chamber 31 therein. An air circulation fan 32 and a heater 33 are installed in the fan chamber 31. The air circulation fan 32 circulates the air of the cooking cavity 11, while the heater 33 heats the circulated air of the cooking cavity 11. The air circulation fan 32 is a centrifugal fan, in which the air is sucked through a central space of the fan 32, and is discharged to the outside of a circumference of the fan 32 in radial directions. The heater 33 is installed inside the fan chamber 31 at a predetermined position around the circumference of the air circulation fan 32 to effectively heat the air which is discharged from the fan 32 in the radial directions.

A heat-shielding unit 34 is mounted to a rear end of the inner casing 13 at a position outside the recessed rear wall 30 of the cooking cavity 11 to intercept heat transmitted from the heater 33 to the outside of the fan chamber 31, as shown in FIGS. 2 and 7. A second drive motor 36 is installed outside the heat-shielding unit 34 to rotate the air circulation fan 32. A second cooling fan 37 is installed at a lower portion of the space between the outer and inner casings 12 and 13 at the back of the cabinet 10, and cools the second drive motor 36.

The heat-shielding unit 34 has two plates, that is, first and second heat-shielding plates 34*a* and 34*b* which are integrated into a single body with a thermal insulating space defined between the two heat-shielding plates 34*a* and 34*b*. The second drive motor 36 is held by a motor bracket 35 which is mounted to an outer surface of the second heat-shielding plate 34*b*. Each of the first and second heat-shielding plates 34*a* and 34*b* has a size larger than a size of the recessed rear wall 30 to define the fan chamber 31 therein. The first and second heat-shielding plates 34*a* and 34*b* overlap each other along outside edges thereof, and are attached along with the recessed rear wall 31 to the rear end of the inner casing 13 at the overlapping edges by use of a plurality of setscrews 38. The motor bracket 35 is mounted to the outer surface of the second heat-shielding plate 34*b* by a plurality of setscrews 39 which are driven from an inner surface of the first heat-shielding plate 34*a* to be threaded into the motor bracket 35 while passing through the second heat-shielding plate 34*b*, as shown in FIG. 7.

Figure 3:
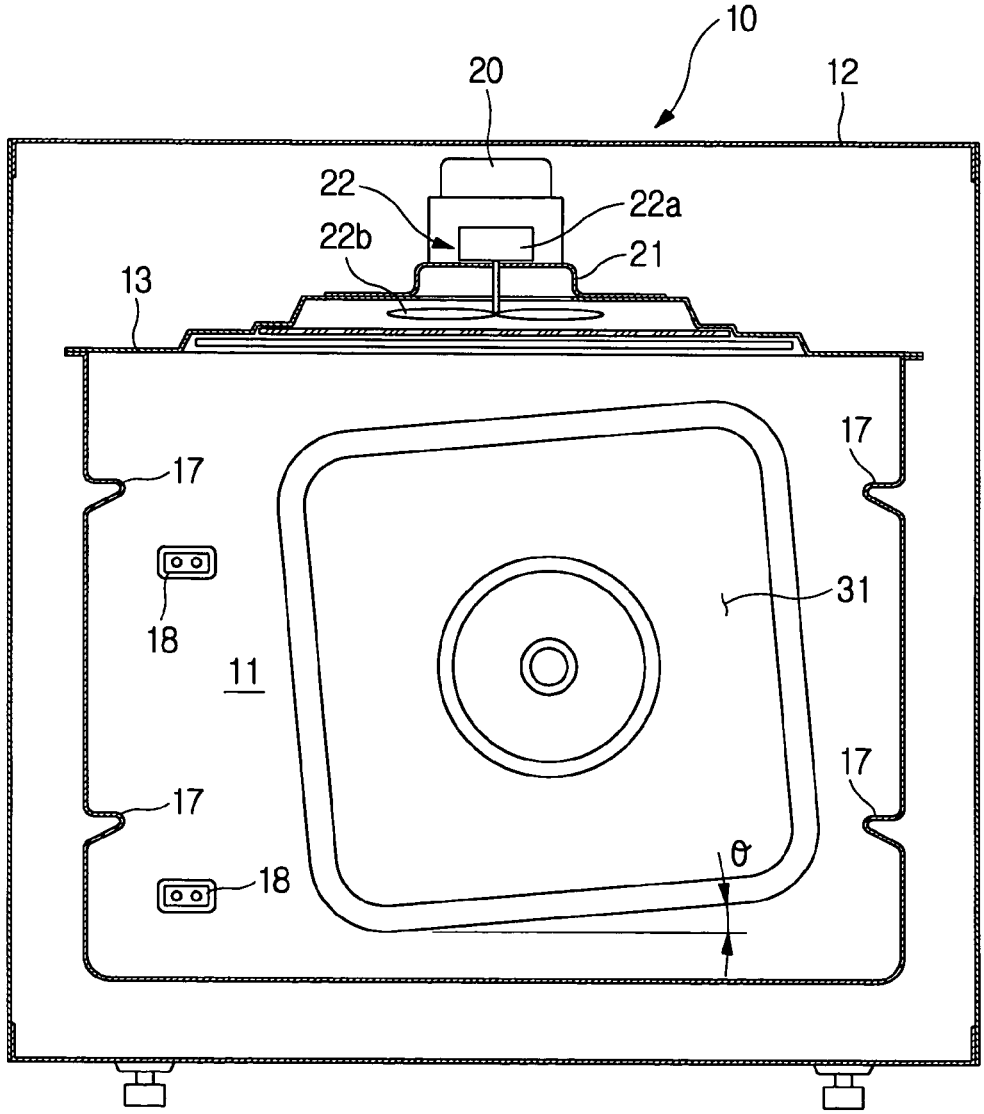
FIG. 3 is a sectional view taken along the line A–A' of FIG. 2, showing an interior structure of the heating cooker when a chamber cover is removed from an inlet of a fan chamber provided in the heating cooker.

A chamber cover 40 is mounted to the open front of the fan chamber 31 to cover the circulation fan 32 and heater 33 installed in the fan chamber 31. As shown in FIG. 3, the fan chamber 31 is defined in the recessed rear wall 30 of the cooking cavity 11 to have a rectangular shape. The chamber cover 40 is a rectangular panel which has a size larger than a size of the open front of the rectangular fan chamber 31, thus effectively covering the open front of the rectangular fan chamber 31.

A plurality of air suction ports 41 are provided at a central area of the chamber cover 40, while a plurality of air distribution ports 42 are provided along an outside edge of the chamber cover 40. The air of the cooking cavity 11 is sucked into the fan chamber 31 through the air suction ports 41 due to suction force generated by the air circulation fan 32 rotated in the fan chamber 31. In the fan chamber 31, the sucked air is forced outward in the radial directions of the air circulation fan 32, and is heated by the heater 33 to become hot air. The hot air is, thereafter, distributed from the fan chamber 31 into the cooking cavity 11 through the air distribution ports 42 of the chamber cover 40. In order to prevent an introduction of the microwaves from the cooking cavity 11 into the fan chamber 31 through the air suction ports 41, each of the air suction ports 41 has a size of $\lambda/4$ or less which scarcely allows the microwaves to pass through the air suction ports 41.

Figure 6:
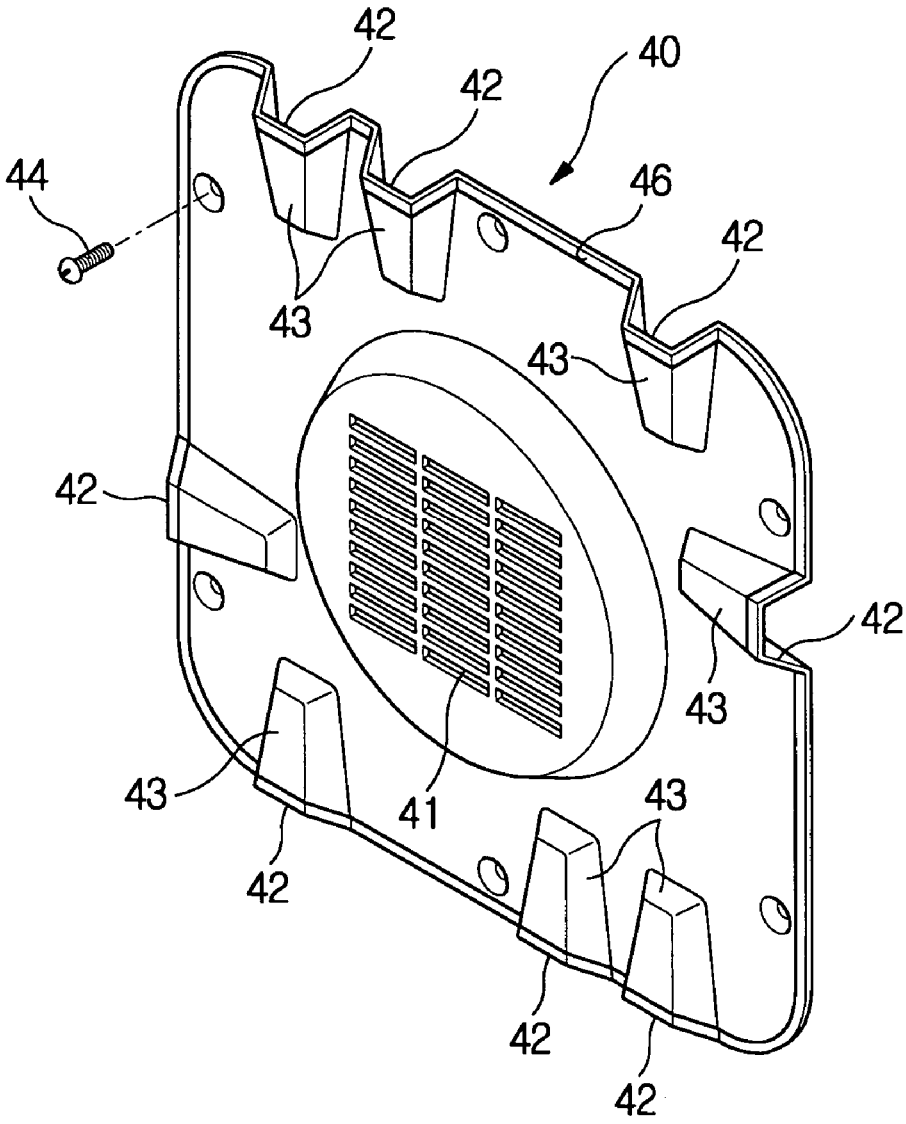
FIG. 6 is a perspective view of the chamber cover of FIG. 4.
Figure 10:
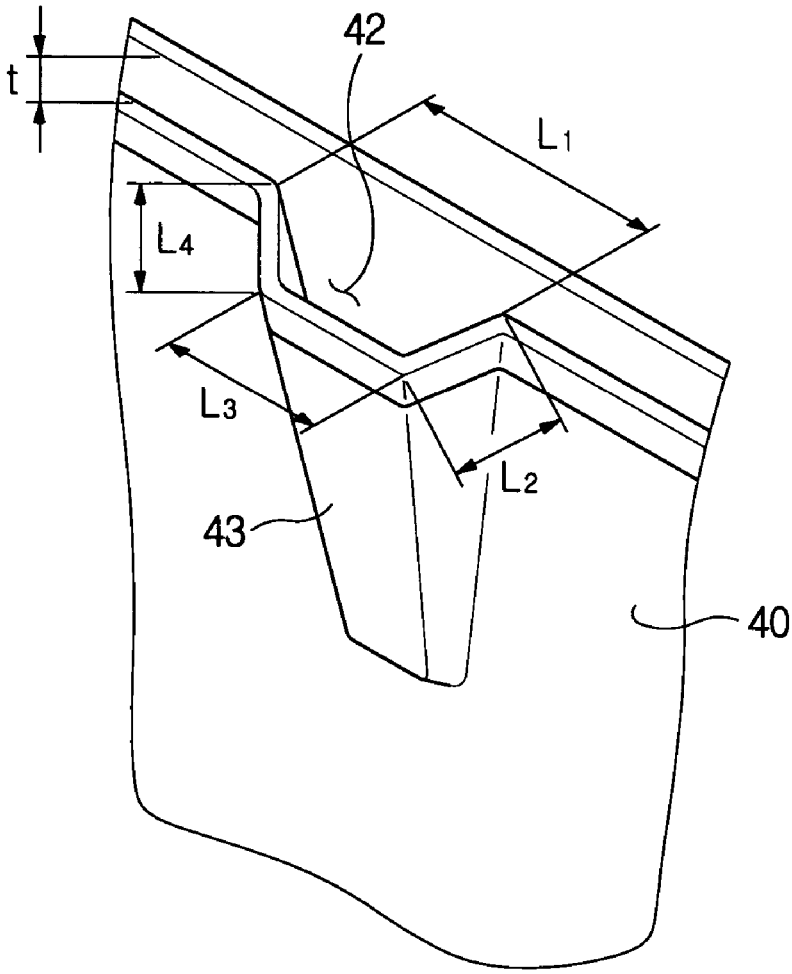
FIG. 10 is a perspective view of an air distribution port provided at the chamber cover according to the present invention.

As shown in FIGS. 2, 6 and 10, the air distribution ports 42 of the chamber cover 40 are defined by a plurality of protuberant parts 43 which are provided along the outside edge of the chamber cover 40 by protruding predetermined portions of the outside edge of the chamber cover 40 toward the cooking cavity 11, such that the protuberant parts 43 form channels which are directed outward and open at the outside edge of the chamber cover 40. The hot air, heated by the heater 33 inside the fan chamber 31, is thus guided to an area outside the edge of the chamber cover 40 through the air distribution ports 42, so that the food in the cooking cavity 11 is prevented from being directly heated by the hot air. Therefore, it is possible to evenly cook the food without excessively cooking or burning a part of the food.

Figure 4:
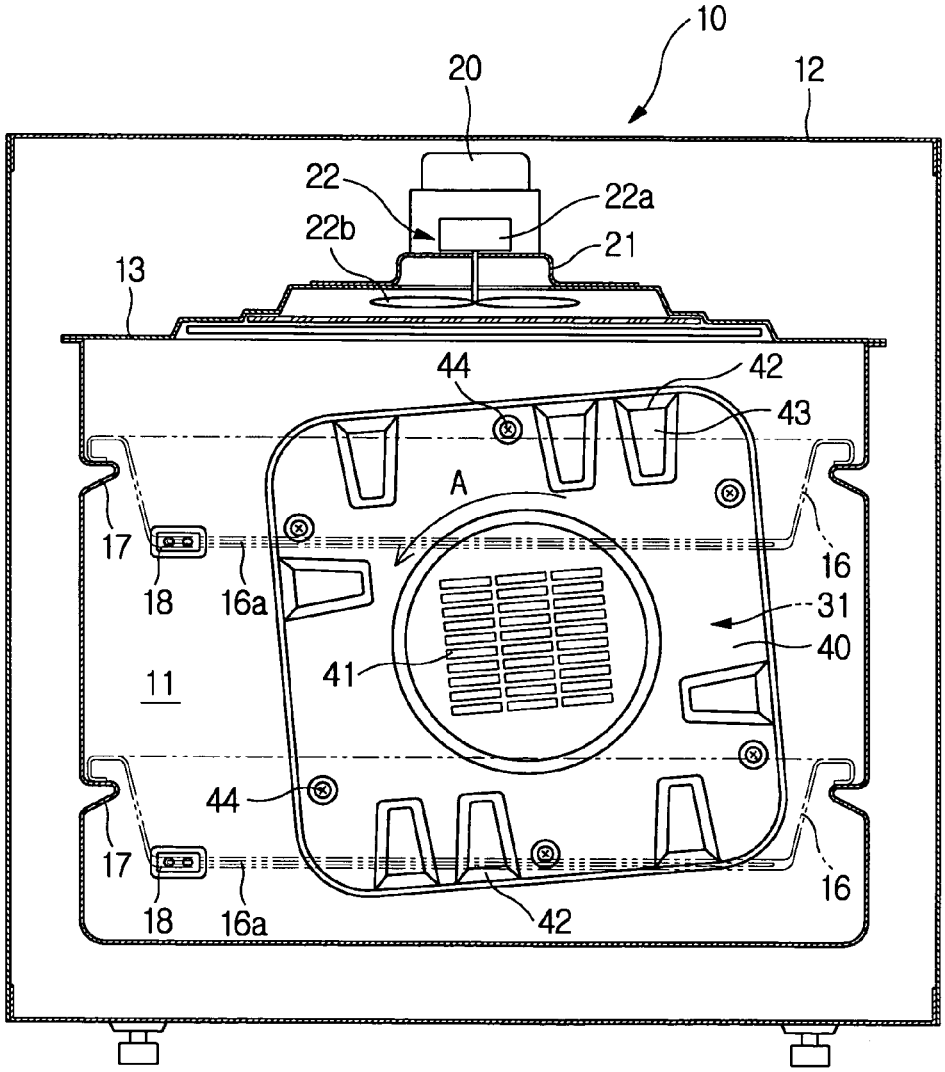
FIG. 4 is a sectional view taken along the line A–A' of FIG. 2, showing the interior structure of the heating cooker when the chamber cover is attached to the inlet of the fan chamber.
Figure 8:
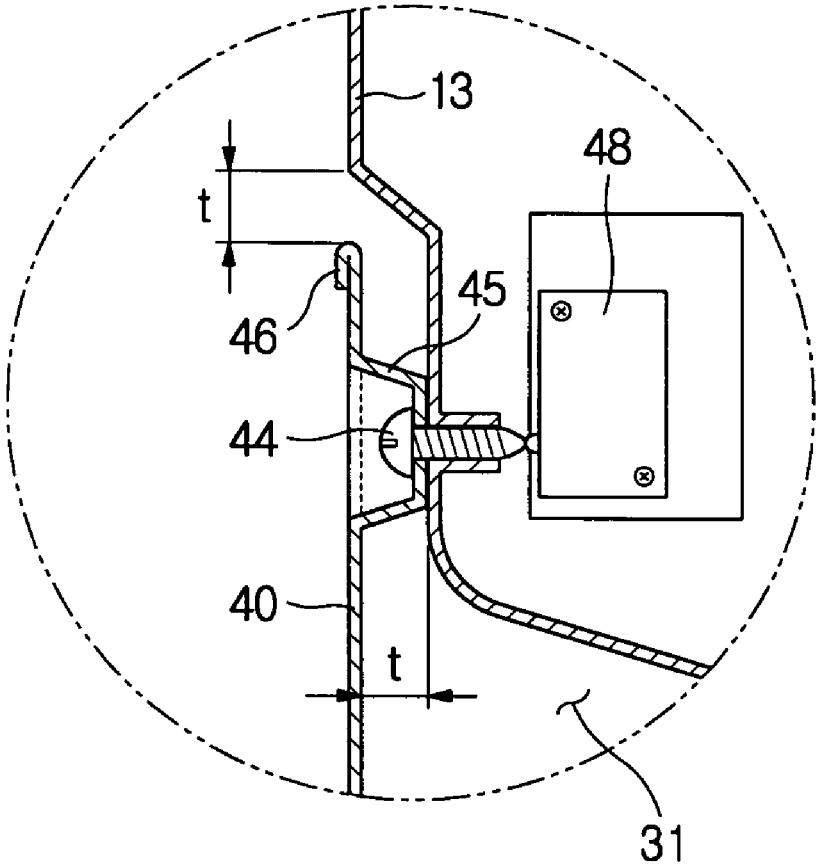
FIG. 8 is a sectional view of a screwed part of the chamber cover of FIG. 6.

In order to prevent an occurrence of sparks caused by the microwaves at both the inner casing 13 and the chamber cover 40 during a microwave-cooking mode of the heating cooker, an inner surface of the inner casing 13 and the chamber cover 40 are coated with enamel which is an insulating material. The outside edge of the chamber cover 40 is folded to form a thick edge 46. The chamber cover 40 is mounted at the edge thereof to an inner surface of the recessed rear wall 30 of the cooking cavity 11 by use of a plurality of setscrews 44, such that a gap "t" is maintained between the edge of the chamber cover 40 and the inner surface of the recessed rear wall 30, as shown in FIGS. 4 and 8. Due to the folded thick edge 46 of the chamber cover 40 and the gap "t" maintained between the edge of the chamber cover 40 and the inner surface of the recessed rear wall 30, it is possible to prevent an electromagnetic field from being formed at the edge of the chamber cover 40 or an area of the recessed rear wall 30 around the edge of the chamber cover 40. Therefore, sparks do not occur at the edge of the chamber cover 40 or the recessed rear wall 30.

In order to allow the chamber cover 40 to be mounted at the edge thereof to the inner surface of the recessed rear wall 30 of the cooking cavity 11 by use of the setscrews 44, with the gap "t" maintained between the chamber cover 40 and the inner surface of the recessed rear wall 30, a plurality of bosses 45 are provided at predetermined positions along the edge of the chamber cover 40, at which the chamber cover 40 is screwed to the recessed rear wall 30 by use of the setscrews 44, as shown in FIG. 8. The bosses 45 are protruded backward from the chamber cover 40 to face the recessed rear wall 30 of the cooking cavity 11.

Figure 9:
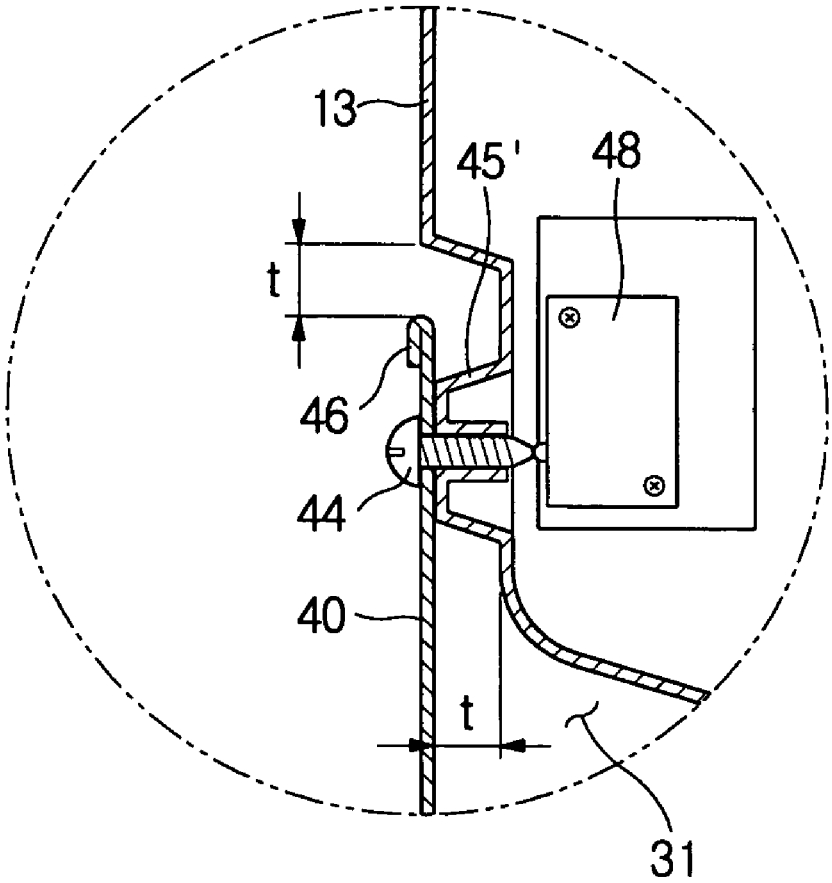
FIG. 9 is a view corresponding to FIG. 8, illustrating another embodiment of the present invention.

FIG. 9 is a view corresponding to FIG. 8, illustrating another embodiment of the present invention. In the embodiment of FIG. 9, a boss 45' is provided on the inner surface of the recessed rear wall 30 of the cooking cavity 11 instead of forming the bosses 45 along the edge of the chamber cover 40. In the present invention, the gap "t" maintained between the edge of the chamber cover 40 and the inner surface of the recessed rear wall 30 is preferably set to 3 mm. The bosses 45 and 45' prevent occurrence of sparks at the edge of the chamber cover 40 or the recessed rear wall 30, and prevent introduction of the microwaves from the cooking cavity 11 into the fan chamber 31, during the microwave-cooking mode. As shown in FIG. 10, the air distribution ports 42 are sized such that a circumference (L1+L2+L3+L4) of each of the air distribution ports 42 is set to $\lambda/2$ or less which scarcely allows the microwaves to enter the fan chamber 31 through the air distribution ports 42.

As described above, in the heating cooker of the present invention, the air suction ports 41 and the air distribution ports 42 of the chamber cover 40 and the gap "t" maintained between the edge of the chamber cover 40 and the inner surface of the recessed rear wall 30 of the cooking cavity 11 do not allow the microwaves of the cooking cavity 11 to enter the fan chamber 31. Therefore, as shown in FIG. 7, the heating cooker of the present invention effectively prevents the microwaves of the cooking cavity 11 from leaking to the atmosphere through the fan chamber 31, without providing a structure to prevent leaking of the microwaves at a portion of a rear part of the fan chamber 31, through which a motor shaft 36*a* of the air circulation fan 32 passes. The heating cooker has a simple structure at the rear part of the fan chamber 31, and reduces the production cost thereof.

As shown in FIGS. 8 and 9, at least one sensing switch 48 is mounted to the outer surface of the inner casing 13 outside the cooking cavity 11 at a position corresponding to one of the setscrews 44 to sense a tightened or released state of the setscrew 44. When a user removes the chamber cover 40 from the recessed rear wall 30 of the cooking cavity 11 to clean the interior of the fan chamber 31, the sensing switch 48 senses the released state of the setscrew 44, and turns both the second drive motor 36 and the heater 33 off, thus allowing the user to safely clean the interior of the fan chamber 31 without being injured.

Figure 5:
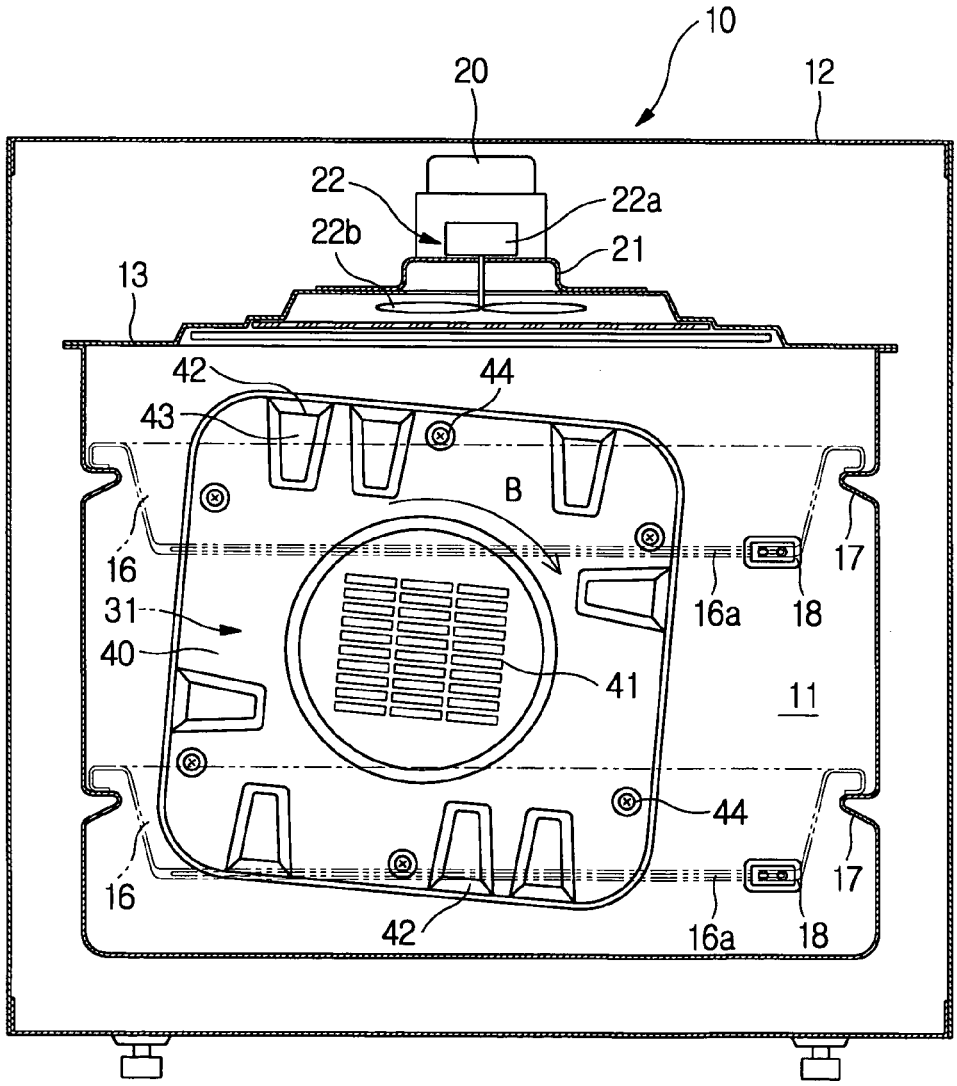
FIG. 5 is a view corresponding to FIG. 4, illustrating another embodiment of the present invention.

In the heating cooker of the present invention, the food racks 16 are provided at upper and lower sections in the cooking cavity 11 to support food therein during a cooking process, as shown in FIGS. 2, 4 and 5. An embedded heater 16*a* is provided in a bottom wall of each of the food racks 16 to heat the food laid in the rack 16. A power connector 18 is provided on the recessed rear wall 30 of the cooking cavity 11 at a position corresponding to each of the food racks 16, thus supplying electric power to the embedded heater 16*a* of the food rack 16. In the present invention, the power connector 18 is designed such that a power plug 16*b* of the food rack 16 is automatically connected to the power connector 18 when the food rack 16 is fully inserted into the cooking cavity 11.

In the present invention, the power connectors 18 corresponding to the food racks 16 are placed at a left or right side of the recessed rear wall 30 of the cooking cavity 11 at positions outside the fan chamber 31, as shown in FIGS. 4 and 5. That is, the power connector 18 may be placed at the left side of the recessed rear wall 40, while the fan chamber 31 may be placed at the right side of the recessed rear wall 30, as shown in FIG. 4. Alternatively, the power connector 18 may be placed at the right side of the recessed rear wall 40, while the fan chamber 31 may be placed at the left side of the recessed rear wall 30, as shown in FIG. 5. In the present invention, it is preferred to arrange the setscrews 44, which lock the chamber cover 40 to the recessed rear wall 30, at positions to correspond to the food racks 16. When the setscrews 44 are arranged at the positions corresponding to the food racks 16 as described above, it is possible to increase the gaps between the air distributing ports 42 of the chamber cover 40 and the food racks 16, thus preventing heat from being concentrated to a part of the food in the racks 16.

When the power connector 18 is placed at the left side of the recessed rear wall 40 of the cooking cavity 11 as shown in FIG. 4, the air circulation fan 32 installed in the fan chamber 31 is rotated counterclockwise as shown by the arrow "A" of FIG. 4. However, when the power connector 18 is placed at the right side of the recessed rear wall 40 as shown in FIG. 5, the air circulation fan 32 is rotated clockwise as shown by the arrow "B" of FIG. 5. The above-described rotating direction of the air circulation fan 32 is determined in consideration with swirling currents of hot air generated in accordance with the rotating direction of the circulation fan 32, when the hot air is discharged from the air distribution ports 42 provided along the edge of the chamber cover 40. That is, the above-described rotating direction of the air circulation fan 32 allows the hot air, discharged from the air distribution ports 42 provided along an upper side of the edge of the chamber cover 40, to easily flow to areas above the power connectors 18, due to the swirling currents of the hot air. When the rotating direction of the air circulation fan 32 is as described above, it is possible to effectively and evenly heat the whole area of the cooking cavity 11 by use of the hot air. In an effort to enhance the above-described effect, the number of the air distribution ports 42, provided at the upper and lower sides of the edge of the chamber cover 40 at trailing positions relative to the rotating direction of the air circulation fan 32, is larger than the number of the air distribution ports 42 provided at leading positions relative to the rotating direction of the air circulation fan 32. Therefore, in FIG. 4, a large part of the hot air which is distributed from the air distribution ports 42 of the chamber cover 40 effectively flows from the right to the left in the upper section of the cooking cavity 11, and, in the lower section of the cooking cavity 11, a large part of the hot air distributed from the air distribution ports 42 effectively flows from the left to the right. Therefore, the hot air from the fan chamber 31 is evenly distributed into the whole area of the cooking cavity 11. In FIG. 5, the flow of the hot air in the upper and lower sections of the cooking cavity 11 is opposite to that of FIG. 4.

In the heating cooker according to the present invention, the fan chamber 31 provided at a back of the cooking cavity 11 is tilted to a side at a predetermined tilted angle "θ". The fan chamber 31 as shown FIG. 3 is tilted to the left at the predetermined tilted angle "θ", which is defined between an inclined lower surface of the fan chamber 31 and a horizontal line. Due to the tilted arrangement of the fan chamber 31, impurities and washing water are easily guided to a lowermost corner of the fan chamber 31 along the inclined lower surface of the fan chamber 31 when the interior of the fan chamber 31 is washed after the chamber cover 40 is removed from the fan chamber 31. Therefore, the impurities and washing water are easily and effectively removed from the fan chamber 31, so that a user easily and effectively performs a fan chamber cleaning process.

As apparent from the above description, the present invention provides a heating cooker, in which hot air of a fan chamber is guided to a plurality of air distribution ports opened outwards at an edge of a chamber cover, and discharged into a cooking cavity. Accordingly, the hot air discharged from the fan chamber is not directly forced to food in the cooking cavity, thus evenly heating and cooking the food without excessively cooking or burning a part of the food.

In addition, the chamber cover has a size larger than a size of an open front of the fan chamber, thus effectively covering the open front of the fan chamber. Thus, it is possible to prevent food from entering the fan chamber even when the food sputters in the cooking cavity during a cooking process. The chamber cover is removed from the fan chamber by releasing setscrews, so that a user is able to easily clean the fan chamber.

Furthermore, the chamber cover is mounted to an inner surface of a recessed rear wall of the cooking cavity, such that a gap is maintained between the edge of the chamber cover and the inner surface of the recessed rear wall. In addition, the outside edge of the chamber cover is folded to form a thick edge, so that it is possible to prevent sparks from occurring at the edge of the chamber cover or an area of the recessed rear wall of the cooking cavity around the edge of the chamber cover.

In the heating cooker according to the present invention, the air suction ports and air distribution ports of the chamber cover, and a spaced mounting structure of the r chamber cover relative to the recessed rear wall of the cooking cavity, are designed to prevent an introduction of the microwaves into the fan chamber. Thus, the heating cooker has a simple structure at a rear part of the fan chamber, and reduces the production cost thereof.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heating cooker, comprising:

a cabinet to define a cooking cavity therein, the cooking cavity being open at a front thereof;

a fan chamber defined by recessing a rear wall of the cooking cavity at a predetermined area to a predetermined depth;

an air circulation fan installed in the fan chamber to circulate air of the cooking cavity;

a heater installed in the fan chamber to heat the air;

a chamber cover mounted to the rear wall of the cooking cavity by use of a plurality of setscrews to cover an open front of the fan chamber, the chamber cover having a plurality of air suction ports at a central area thereof, with a plurality of air distribution ports provided along an edge of the chamber cover to guide the air from the fan chamber to the edge of the chamber cover to discharge the air to the cooking cavity, wherein the plurality of air distribution ports are provided along the edge of the chamber cover so that the air is not directly forced onto food in the cooking cavity; and a sensing switch provided outside the cooking cavity to sense a tightened or released state of the setscrews which mount the chamber cover to the rear wall of the cooking cavity.

2. A heating cooker, comprising:

a cabinet to define a cooking cavity therein, the cooking cavity being open at a front thereof;

a fan chamber defined by recessing a rear wall of the cooking cavity at a predetermined area to a predetermined depth;

an air circulation fan installed in the fan chamber to circulate air of the cooking cavity;

a heater installed in the fan chamber to heat the air;

a chamber cover mounted to the rear wall of the cooking cavity to cover an open front of the fan chamber, the chamber cover having a plurality of air suction ports at a central area thereof, with a plurality of air distribution ports provided along an edge of the chamber cover to guide the air from the fan chamber to the edge of the chamber cover to discharge the air to the cooking cavity, wherein the plurality of air distribution ports are provided along the edge of the chamber cover so that the air is not directly forced onto food in the cooking cavity;

a food rack having an embedded heater provided in the cooking cavity to support food therein; and a power connector provided on the rear wall of the cooking cavity at a position corresponding to the food rack to supply electric power to the embedded heater of the food rack.

3. The heating cooker according to claim 2, wherein the fan chamber is placed at a left or right side of the rear wall of the cooking cavity, and the power connector is provided on the rear wall of the cooking cavity at a side which does not have the fan chamber.

4. The heating cooker according to claim 3, wherein when the power connector is placed at the left side of the rear wall of the cooking cavity, the air circulation fan is rotated counterclockwise, and when the power connector is placed at the right side of the rear wall of the cooking cavity, the air circulation fan is rotated clockwise.

5. A heating cooker, comprising:

a cabinet to define a cooking cavity therein, the cooking cavity being open at a front thereof;

a fan chamber defined by recessing a rear wall of the cooking cavity at a predetermined area to a predetermined depth;

an air circulation fan installed in the fan chamber to circulate air of the cooking cavity;

a heater installed in the fan chamber to heat the air; and a chamber cover mounted to the rear wall of the cooking cavity to cover an open front of the fan chamber, the chamber cover having a plurality of air suction ports at a central area thereof, with a plurality of air distribution ports provided along an edge of the chamber cover to guide the air from the fan chamber to the edge of the chamber cover to discharge the air to the cooking cavity, wherein the plurality of air distribution ports are provided along the edge of the chamber cover so that the air is not directly forced onto food in the cooking cavity, wherein the fan chamber is defined in the rear wall of the cooking cavity to have a rectangular shape, and is tilted to a side so that a lower surface of the fan chamber is inclined to remove impurities and washing water from the chamber.

6. The heating cooker according to claim 5, wherein the chamber cover has a rectangular shape to cover the open front of the fan chamber, and a number of the air distribution ports, provided at upper and lower sides of the edge of the chamber cover at trailing positions relative to a rotating direction of the air circulation fan, is larger than a number of the air distribution ports provided at leading positions relative to the rotating direction of the circulation fan.

7. A heating cooker, comprising:

a cabinet to define a cooking cavity therein, the cooking cavity being open at a front thereof;

a fan chamber defined by recessing a rear wall of the cooking cavity at a predetermined area to a predetermined depth;

an air circulation fan installed in the fan chamber to circulate air of the cooking cavity;

a heater installed in the fan chamber to heat the air; and a chamber cover mounted to the rear wall of the cooking cavity to cover an open front of the fan chamber, the chamber cover having a plurality of air suction ports at a central area thereof, with a plurality of air distribution ports provided along an edge of the chamber cover to guide the air from the fan chamber to the edge of the chamber cover to discharge the air to the cooking cavity, wherein the plurality of air distribution ports are provided along the edge of the chamber cover so that the air is not directly forced onto food in the cooking cavity, wherein the chamber cover is mounted to an inner surface of the rear wall of the cooking cavity by a setscrew, and a sensing switch is provided outside the cooking cavity to sense a tightened or released state of the setscrew which mounts the chamber cover to the rear wall of the cooking cavity.

* * * * *

UNITED STATES PATENT AND TRADEMARK OFFICE

CERTIFICATE OF CORRECTION

PATENT NO. : 7,094,998 B2
APPLICATION NO. : 10/749378
DATED : August 22, 2006
INVENTOR(S) : Kobayashi Shozo et al.

It is certified that error appears in the above-identified patent and that said Letters Patent is hereby corrected as shown below:

On Title Page, Item (54), change "HEATING COOKER" to --A HEATING COOKER FOR EVENLY DISTRIBUTING HOT AIR IN COOKING CHAMBER--.

Column 1, Line 1, change "HEATING COOKER" to --A HEATING COOKER FOR EVENLY DISTRIBUTING HOT AIR IN COOKING CHAMBER--.

Signed and Sealed this

Thirtieth Day of January, 2007

JON W. DUDAS
*Director of the United States Patent and Trademark Office*